United States Patent [19]

Larsen

[11] 4,291,544

[45] Sep. 29, 1981

[54] CONTROL APPARATUS FOR THE LOW PRESSURE EVAPORATOR OF A REFRIGERATION PLANT

[75] Inventor: Kurt A. Larsen, Nordborg, Denmark

[73] Assignee: Danfoss A/S, Denmark

[21] Appl. No.: 135,973

[22] Filed: Mar. 31, 1980

Related U.S. Application Data

[63] Continuation of Ser. No. 949,223, Oct. 6, 1978, abandoned.

[30] Foreign Application Priority Data

Oct. 13, 1977 [DE] Fed. Rep. of Germany ..... 2745988

[51] Int. Cl.[3] ..... F25B 41/04

[52] U.S. Cl. ..... 62/221; 137/413; 236/80 G

[58] Field of Search ..... 62/220, 221, 219; 137/413, 491; 251/44; 236/80 G

[56] References Cited

U.S. PATENT DOCUMENTS 2,266,069 12/1941 Phillips ..... 62/219

2,664,916 1/1954 Conley ..... 251/44 X 3,401,605 9/1968 Born ..... 137/491 X

*Primary Examiner*—William E. Wayner

*Attorney, Agent, or Firm*—Wayne B. Easton

[57] ABSTRACT

The invention relates to control apparatus for feeding liquified refrigerant to the evaporator of a refrigeration system. A main valve controlled by a differential pressure type servo-element controls the flow of refrigerant to the evaporator. A float type pilot valve has a nozzle and closure member controlled by a float which has a liquid level identical to liquid level in the evaporator. A pilot conduit which extends between the main valve and the pilot valve has first and second throttle units arranged in series. The first throttle unit controls a flow of liquid refrigerant through the pilot conduit to control the main valve. The second throttle unit controls a flow of refrigerant through the pilot conduit which is at least partially in vapor form. This arrangement with two throttle units allows control over a broader proportional range for the settings of the float in the pilot valve.

5 Claims, 3 Drawing Figures

CONTROL APPARATUS FOR THE LOW PRESSURE EVAPORATOR OF A REFRIGERATION PLANT

Figure 1:
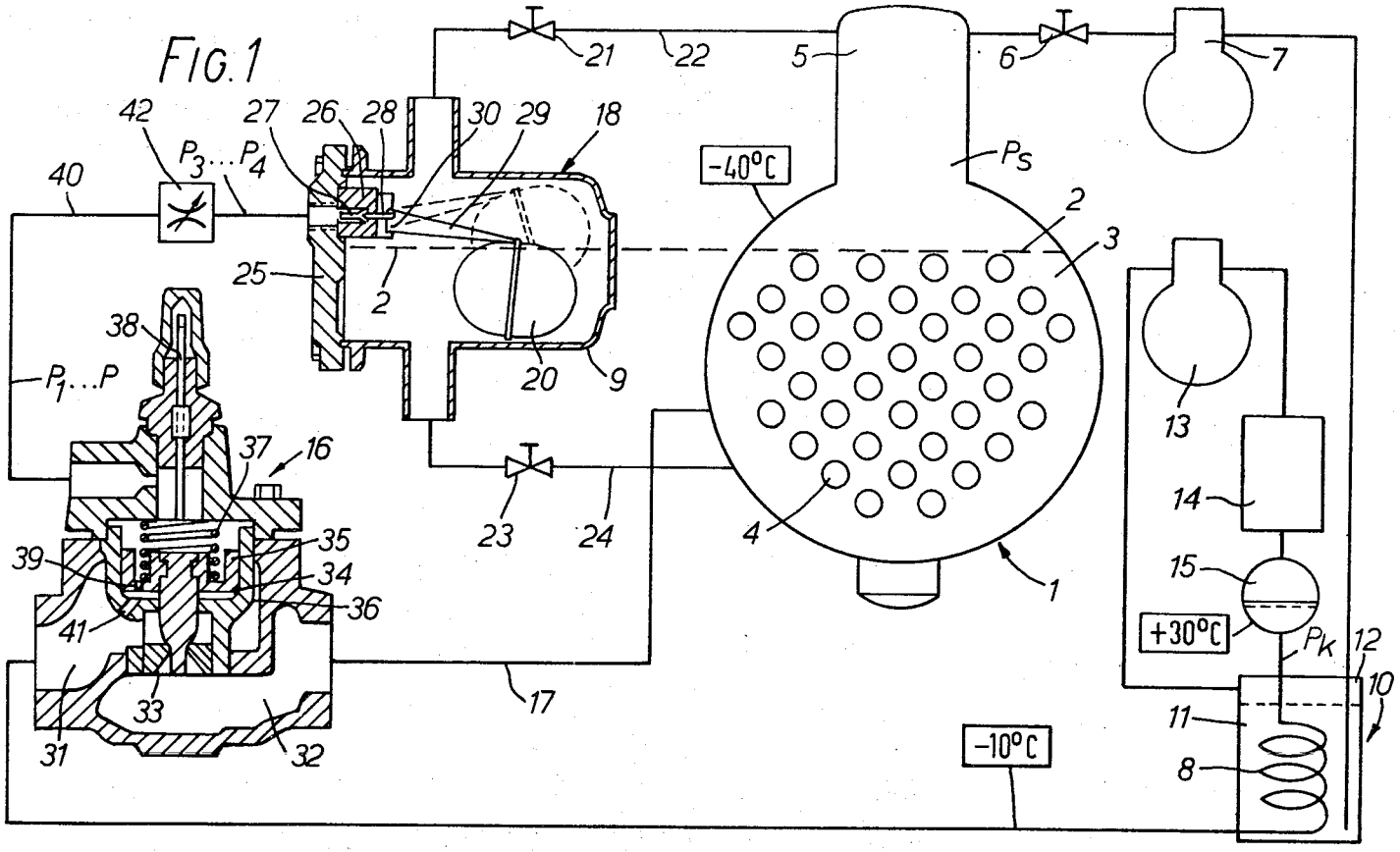

This application is a Continuation of Application Ser. No. 949,223 filed Oct. 6, 1978, now abandoned.

The invention relates to a control apparatus for the low pressure evaporator of a refrigeration plant, comprising a main valve of which the closure member is controlled by a differential pressure-actuated servo-element, a pilot valve of which the closure member is controlled by a float governed by the level in the evaporator, and a pilot conduit leading to the seat of the pilot valve from the supply side of the main valve by way of a first throttle serving to produce the pressure difference acting on the servo-element.

In a known control apparatus of this kind, as shown for example in U.S. Pat. No. 2,266,069, the servo-element of the main injection valve is in the form of a spring-influenced piston which is penetrated by a bore forming the first throttle. The pilot valve opens into a vessel containing the float, the vessel being connected to the vapor chamber as well as the liquid chamber of the low pressure evaporator in the manner of communicating vessels. If the level of the liquid refrigerant drops in the evaporator, the pilot valve will open; the amount of refrigerant flowing through the first throttle gives rise to a pressure difference acting on the servo-piston and opening the main valve so that refrigerant can flow from the evaporator until the pilot valve and thus the main valve close again.

With normal sub-cooling of the refrigerant, i.e. by about 0° C. to 6° or 8° C., the pressure drop at the first throttle leads to expansion and thus to partial vapour formation, so that the pilot valve controls a liquid-vapour mixture having a considerably larger volume than the amount of liquid refrigerant flowing through the first throttle. This is advantageous because a comparatively large setting distance of the float-controlled closure member of the pilot valve can be associated with the operating range of the pressure difference at the servo-element of the main valve. In this way one obtains control with a suitably wide proportional range (P band). For the case where there is only little sub-cooling of the refrigerant and consequently excessive vapor formation, a bypass throttle in the form of a fixed but exchangeable nozzle has already been provided to bridge the pilot valve. This enables the setting distance of the closure member of the pilot valve also under these conditions to be adapted to the differential pressure range necessary for full control of the main valve. However, difficulties occur if the refrigerant is sub-cooled more intensively, for example by 40° C. The proportional range will then be contracted so that the main valve will practically operate only as an on-off valve.

The invention is based on the problem of providing a control apparatus of the aforementioned kind having a proportional range of suitable width even in the case of a more intensively sub-cooled refrigerant.

This problem is solved according to the invention in that a second throttle is connected in the pilot conduit in series between the first throttle and the seat of the pilot valve.

In this construction, the throttle resistance is artificially increased in the pilot conduit upstream of the pilot valve without the throttle resistance of the first throttle responsible for the pressure difference being increased. As a result, even more intensively sub-cooled refrigerant upstream of the pilot valve will be expanded to such an extent that a liquid-vapour mixture is formed at this position, whereby one obtains an increase in volume which is meaningful for a wider proportional band. The arrangement of the second throttle downstream of the first throttle ensures that the liquid refrigerant will flow through the first throttle under all operating conditions.

Desirably, the second throttle is adjustable. This permits adaptation of the control apparatus to particular operating conditions, particularly the sub-cooling temperature of the refrigerant, and it makes it possible to set any desired width of proportional range for every sub-cooling temperature.

It is advantageous if the second throttle comprises a setting member sealingly passed to the outside. The setting can then be effected during operation of the refrigeration plant.

The second throttle may be built into the housing of the pilot valve. The pilot conduit need therefore not be interrupted to build in this throttle.

If the control apparatus has a preferably adjustable bypass throttle bridging the pilot valve, as is suitable for operation with little sub-cooling, it is advisable to provide switch-over means with which the parts of the bypass throttle can be selectively connected in the pilot conduit as the second throttle. Such a control apparatus can be used universally. Since the second throttle is necessary only for intensive sub-cooling and the bypass throttle only for little sub-cooling, one can make rational use of the same parts for both throttling functions.

From a constructional point of view, a very simple solution is obtained in that the housing of the pilot valve contains two passages which can be connected in parallel to the pilot conduit, lead to a vessel for the float and are interconnected by the second bypass throttle, the seat of the pilot valve being disposed at the outlet of the first passage, and that the switch-over means comprise a first blocking element for selectively shutting the inlet of the first or second passage and a second blocking element to shut the outlet of the second passage when its inlet is free. In particular, the blocking elements may be closure screws.

Figure 2:
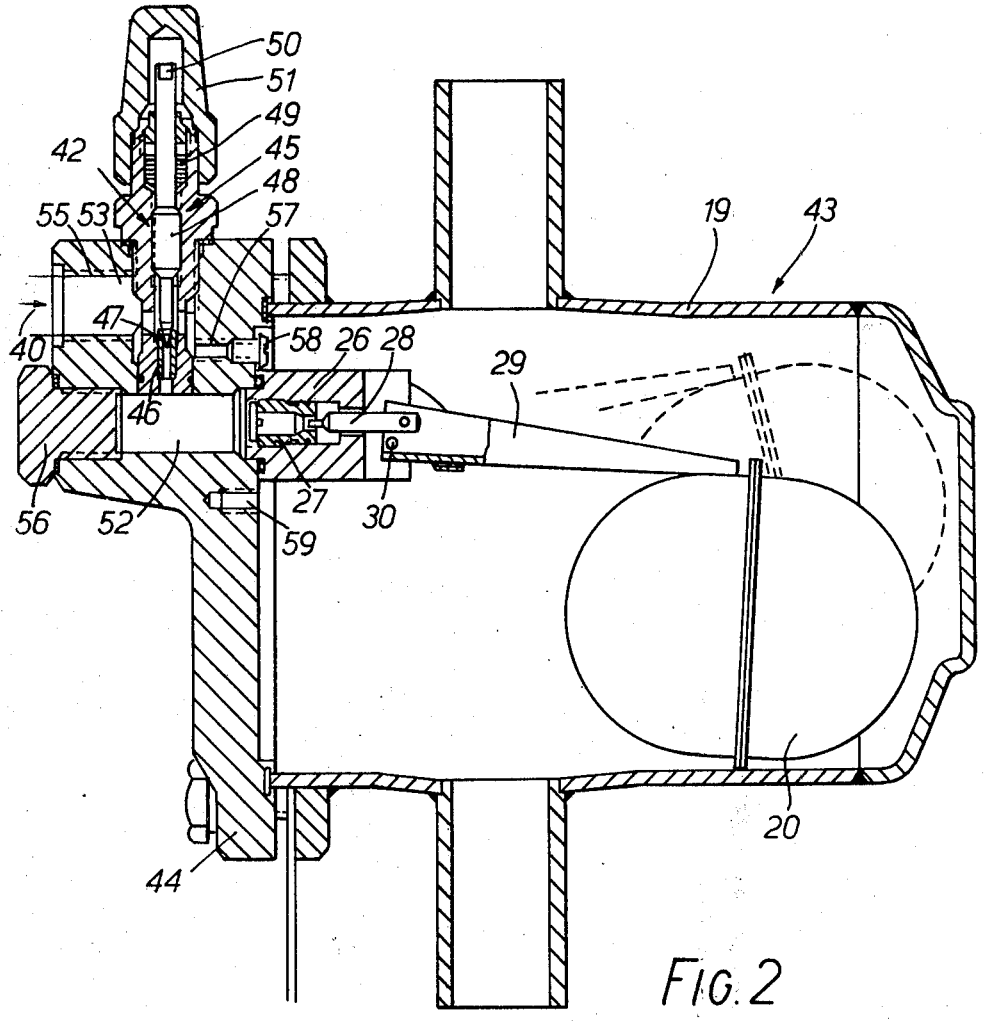
Figure 3:
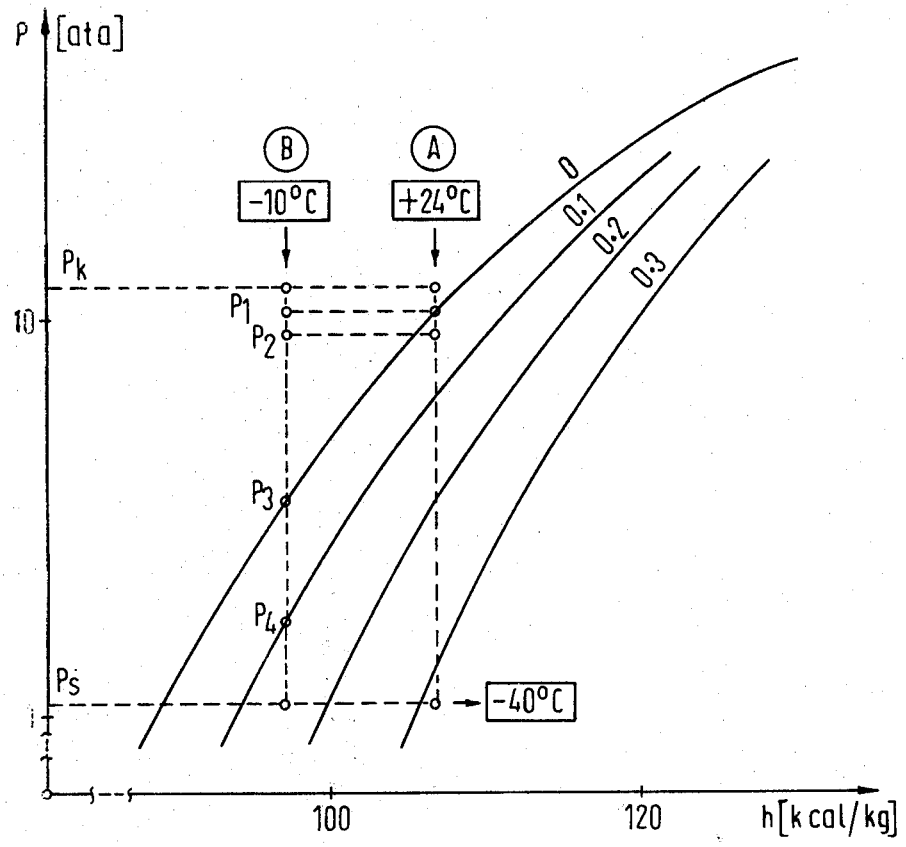

The invention will now be described in more detail with reference to examples illustrated in the drawing, wherein:

FIG. 1 shows a refrigeration plant with a diagrammatically illustrated control apparatus according to the invention, FIG. 2 shows one embodiment of a float-controlled pilot valve with a second or bypass throttle, and FIG. 3 is a Mollier diagram to explain the function of the refrigeration plant.

The refrigeration plant of FIG. 1 comprises a flooded evaporator 1 filled with liquid refrigerant up to a level 2 to form a liquid chamber 3 containing tubes 4 of a heat-exchanger and a superposed vapour chamber 5.

By way of a stop valve 6, the vapour chamber 5 communicates with a low-pressure compressor 7 which compresses refrigerant liquefied in an intermediate cooler 10 containing convolutions of tubing 8, the intermediate cooler also having a liquid chamber 11 and a vapour chamber 12. Refrigerant is sucked from the vapour chamber by a high pressure compressor 13 and supplied to a condenser 14 whilst being again compressed. The refrigerant that is there liquefied arrives in a liquid collector 15. It is intensively sub-cooled in the convolutions of tubing 8 of the intermediate cooler 10 and arrives at a servo-controlled main valve 16 with the aid of which the sub-cooled refrigerant is led with appropriate throttling by way of a conduit 17 into the liquid chamber 3 of the flooded evaporator 1. After evaporation of the thus supplied refrigerant, the cycle is repeated.

In FIG. 1 temperatures are entered by way of example that could occur in this plant. If the condenser 14 is cooled by air in the room, the condensate collected in the liquid collector 15 can have a temperature of +30° C. This condensate is cooled to −10° C. in the convolutions of tubing 8 of the intermediate cooler 10. The refrigerant also has this temperature in the main valve 16. This corresponds to sub-cooling of 40° C. A temperature of −40° C. obtains in the evaporator.

A pilot valve 18 is provided to control the main valve 16. The pilot valve possesses a vessel 19 for a float 20 of which the top is connected to the vapour chamber 8 by way of a conduit 22 provided with a stop valve 21 and the underside is connected to the liquid chamber 3 of the evaporator 1 by way of a conduit 24 provided with a stop valve 23. In this way one obtains communicating vessels so that the liquid level 2 will also obtain in the vessel 19. The vessel 19 is closed on one side by a cover 25 which, in a block 26, contains the seat 27 of the pilot valve in the form of a nozzle. The associated closure member 28 is hinged to an angular lever 29 which also carries the float 20 and is pivotable about a pivot point 30.

The main valve 16 comprises an inlet chamber 31, an outlet chamber 32 and a valve seat 33 disposed therebetween. Co-operating with the latter there is a closure member 34 which is moved to and fro by a servo-piston 35 guided in a cylinder insert 36. The servo-piston is influenced by a spring 37, of which the bias is adjustable by means of a setting element 38, and the pressure drop at a first throttle 39 formed in the piston as a nozzle orifice. A pilot conduit 40 leads from the inlet chamber 31 by way of a connecting bore 41, said first throttle 39 and a second adjustable throttle 42 in series therewith to the seat 27 of the pilot valve 18.

When the float-controlled pilot valve 18 is closed, no refrigerant can flow in the pilot conduit 40. No pressure drop occurs at the first throttle 39. Consequently the main valve 16 is closed under the force of the spring 37 and the differential pressure acting on the closure member 34. When the liquid level 2 drops and the pilot valve 18 opens, liquid refrigerant reaches the vessel 19 by way of the first throttle 39, the second throttle 42 and the seat 27 of the pilot valve 18. This gives rise to a pressure drop at the first throttle point 39 and, if the pressure drop is sufficiently large, it overcomes the force of the spring 37 and the differential pressure to open the main valve. The second throttle 42 is set so that such a pressure drop occurs at it that a liquid-vapour mixture is formed downstream thereof. By reason of the adjustability of the second throttle 42, this is possible even if the refrigerant is intensively sub-cooled. Owing to the increase in volume, a throttle resistance is set up at the pilot valve such that adequately large displacements of the float can be carried out with small pressure difference fluctuations at the servo-piston 35 of the main valve 16. This results in an appropriately broad proportional range.

In the FIG. 2 embodiment, substantially the same parts are used for the pilot valve 43 as in FIG. 1. Accordingly, the same reference numerals are used. In this case the cover 44 is differently constructed. It carries an adjustable throttling device 45 which here serves as second throttle 42' so that no special component need be inserted in the pilot conduit 40. The throttling device 45 comprises a nozzle 46 in which a needle 47 engages that is part of a screw-threaded setting element 48 which is led to the outside through a seal 49 and can there be adjusted by a square key. In the rest condition, this setting element is covered by a cap 51. The nozzle 46 extends between two parallel passages 52 and 53 of which each inlet is provided with a screwthread 54 or 55 for attaching the pilot conduit 40. In the present case, the pilot conduit 40 is connected to the inlet of the second passage 53 whereas the inlet of the passage 52 is closed by a blocking element 56 in the form of a closure screw engaging in the screwthread 54. The end of the first passage 52 is formed by the seat 27 of the pilot valve 43. The outlet of the second passage 53 is formed by a tapped hole 57 in which a second blocking element 58 in the form of a closure screw is engaged.

Consequently, refrigerant arriving by way of the pilot conduit 40 flows from the passage 53 by way of the throttling device 45 to the passage 52 and thence by way of the seat 27 of the pilot valve 43 into the vessel 19. The manner of operation is then the same as in FIG. 1.

A switch-over device comprises the two blocking elements 56 and 58. If one secures the pilot conduit 40 to the screwthread 54 of the first passage 52 and the blocking element 56 in the screwthread 55 of the second passage 53 and if one removes the blocking element 58 from the tapped hole 57 and places it in a blind hole 59, one obtains a float-controlled pilot valve in which the throttling device 45 now forms a bypass throttle by way of which, depending on the setting, a smaller or larger proportion of the refrigerant can be led past the seat 27 of the pilot valve 43. If, therefore, an only slightly sub-cooled refrigerant is present which already exhibits intensive vaporisation after passing through the first throttle point 39 at the main valve 16, one can with the aid of this bypass throttle pass a smaller or larger proportion of the liquid-vapour mixture past the seat 27 of the pilot valve 43. Consequently the setting range of the pilot valve suffices for controlling the main valve over the entire pressure difference range.

The pilot valve of FIG. 2 can therefore be used for refrigerant of any desired sub-cooling whilst retaining all its important parts, an adequately broad proportional range being in each case achievable with the aid of the parts of the throttle 45, irrespective of whether the latter is in series with the pilot valve as a second throttle or connected in parallel thereto as a bypass throttle.

FIG. 3 is a Mollier diagram for a refrigerant, in this case chlorodifluoromethane (R22), in the usual representation in which the zero point is suppressed, the enthalpy h is entered linearly along the abscissa in kcal/kg and the pressure P is entered logarithmically along the ordinate in atmospheres. The heavy curve O in full lines separate the pure liquid region thereabove and the region of a liquid-vapour mixture therebelow, the thin full line giving the proportion of vapour in percent by weight. Two cases are examined in which the refrigerant is supplied to the main valve 16 with the same condenser pressure $P_k$ and in which expansion is to the same low pressure $P_s$ existing in the evaporator 1 and corresponding to a temperature of −40° C. In case A, normal sub-cooling from 6° C. is assumed, so that the refrigerant is supplied to the main valve 16 at a temperature of 24° C. In case B intensive sub-cooling by 40° C. is assumed, so that the refrigerant supplied to the main valve 16 has a temperature of −10° C.

If the pilot valve 18 opens slightly in case A, a small amount of liquid refrigerant flows by way of the first throttle 39 in the piston 35 of the main valve 16 and there produces a pressure drop so that a pressure $P_1$ exists at the outlet of this throttle. With a larger opening of the pilot valve 18, this pressure drop is higher so that the pressure $P_2$ exists at the outlet of the first throttle. The remaining pressure drop between $P_1$ and $P_2$ and the low pressure $P_s$ occurs between the seat 27 and closure member 28 of the pilot valve 18. The more the pilot valve is open, the further will the pressure behind the first throttle drop below the heavy full line O of the Mollier diagram, which means that the proportion of vapour between the first throttle and the pilot valve increases. Consequently the pilot valve not only processes liquid refrigerant but a liquid-vapour mixture of which the volume increases with an increase in the demand for refrigerant. In this control, this leads to a broad P band.

If one transfers these conditions to case B, it is found that the same quantities of liquid produce the same pressure drop at the first throttle 39 but behind this throttle liquid refrigerant is present over the entire control range. As a result, even very small alterations in the pilot valve will cause large alterations in the refrigerant that is fed in. The P band is correspondingly narrow.

If in case B the second throttle 42 according to the invention is now disposed between the first throttle 39 and the pilot valve 18, an additional pressure drop occurs at this throttle. With slight opening of the pilot valve 18, this additional pressure drop leads to the pressure $P_3$ behind the second throttle and with a wide opening of the pilot valve it leads to the pressure $P_4$ at this position. The result of this is that behind the second throttle there is a liquid-vapour mixture over the greater part of the control range and with the aid of this the width of the P band is appropriately increased.

In this way one achieves that, even with intensively sub-cooled refrigerant, one obtains a comparatively large change of the level in the evaporator 1 for a given control range and this can be utilised in the associated float-controlled pilot valve 18.

What is claimed is:

1. Control apparatus for a refrigerator plant evaporator, comprising, a float type pilot valve connectable to said evaporator and having a float chamber which assumes the same liquid level as said evaporator, said pilot valve having a nozzle and closure member for adjusting the flow through said nozzle, said pilot valve having a float for controlling said closure member, a main valve connectable to said evaporator for supplying liquid refrigerant thereto, said main valve having a closure member and a differential pressure actuated servo-means for controlling said main valve closure member, pilot conduit means extending from said main valve to said nozzle of said pilot valve, first throttle means for controlling a liquid flow for operating said servo-means, said first throttle means having the inlet thereof on the supply side of said main valve and the outlet thereof in fluid communication with said pilot conduit means, and second throttling means in said pilot conduit means downstream from said first throttling means and in series relationship to said nozzle of said pilot valve for introducing a desired throttling resistance downstream of said first throttling resistance to produce a desired fluid expansion to obtain a fluid mixture having a correspondingly desired liquid/vapor ratio making said mixture optimally suitable for control by said pilot valve.

2. Control apparatus according to claim 1 wherein said second throttling means is adjustable.

3. Control apparatus according to claim 1 wherein said second throttle means is built into the housing of said pilot valve.

4. Control apparatus according to claim 1 wherein said second throttle means has the outlet thereof directing fluid flow to said pilot valve nozzle.

5. Control apparatus according to claim 1 wherein said pilot conduit means includes a bypass shunting said pilot valve nozzle and extending into said float chamber, said second throttling means being in said bypass.

* * * * *